US006263703B1

(12) United States Patent
Kenney

(10) Patent No.: US 6,263,703 B1
(45) Date of Patent: Jul. 24, 2001

(54) CLIP ON PROTECTIVE EARRING

(76) Inventor: Bonnie Clare Kenney, 7635 Ridgewood Dr., Gladstone, OR (US) 97027

( * ) Notice: Subject to any disclaimer, the term of this patent is extended or adjusted under 35 U.S.C. 154(b) by 0 days.

(21) Appl. No.: 09/365,046

(22) Filed: Jul. 30, 1999

(51) Int. Cl.[7] ..... A44C 7/00

(52) U.S. Cl. ..... 63/14.1; 63/14.4; 63/14.5; 63/14.3; 24/507; 24/510; 24/564

(58) Field of Search ..... 63/12, 14.1, 14.3, 63/14.4, 14.5, 14.8; 24/510, 507, 564, 90.5

(56) References Cited

U.S. PATENT DOCUMENTS

| | | | | |
|---|---|---|---|---|
| 208,968 | * | 10/1878 | Dolloff | 63/12 |
| 487,757 | * | 12/1892 | Mix | 24/564 |
| 1,151,556 | * | 8/1915 | Barney | 24/565 |
| 1,195,324 | * | 8/1916 | Allen | 63/14.3 |
| 1,978,652 | * | 10/1934 | Shea | 63/14.8 |
| 2,063,924 | * | 12/1936 | Hanko | 248/229.23 |
| 2,325,212 | * | 7/1943 | Adams | 24/507 |
| 2,553,070 | * | 5/1951 | Van Megroot | 602/22 |
| 2,611,251 | * | 9/1952 | Guth | 63/14.8 |
| 2,763,999 | * | 9/1956 | Norman | 63/14.3 |
| 2,929,166 | * | 3/1960 | Sneide | 43/4 |
| 3,129,970 | * | 4/1964 | St. John | 81/53.11 |
| 3,149,390 | * | 9/1964 | McCoy | 24/564 |
| 3,768,275 | * | 10/1973 | Blumstein et al. | 63/14.5 |
| 4,944,164 | * | 7/1990 | Butler et al. | 63/12 |
| 5,052,194 | * | 10/1991 | Jarus | 63/14.3 |
| 5,829,273 | * | 11/1998 | Weingast et al. | 63/14.5 |

* cited by examiner

*Primary Examiner*—Anthony Knight
*Assistant Examiner*—Andrea Chop

(57) ABSTRACT

A clip on protective earring for attachment to a user's ear to protect a sensitive newly formed piercing in the ear lobe. The clip on protective earring includes a pair of body members pivotally coupled together so that inner faces of the body members face each other. The inner faces of the body members are biased towards one another. The inner face of each body member has a concave cupped region with an arcuate pad disposed therein.

1 Claim, 2 Drawing Sheets

CLIP ON PROTECTIVE EARRING

BACKGROUND OF THE INVENTION

1. Field of the Invention

The present invention relates to devices for protecting sensitive ear piercing from contact with other objects and more particularly pertains to a new clip on protective earring for attachment to a user's ear to protect a sensitive newly formed piercing in the ear lobe.

2. Description of the Prior Art

The use of devices for protecting sensitive ear piercing from contact with other objects is known in the prior art. Niore specifically, devices for protecting sensitive ear piercing from contact with other objects heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,154,068; U.S. Pat. No. 5,743,113; U.S. Pat. No. 4,796,443; U.S. Pat. No. 5,379,611; U.S. Pat. No. 4,188,799; and U.S. Pat. No. Design 283,205.

While these devices fulfill their respective, particular objectives and requirements, the aforementioned patents do not disclose a new clip on protective earring. The inventive device includes a pair of body members pivotally coupled together so that inner faces of the body members face each other. The inner faces of the body members are biased towards one another. The inner face of each body member has a concave cupped region with an arcuate pad disposed therein.

In these respects, the clip on protective earring according to the present invention substantially departs from the conventional concepts and designs of the prior art, and in so doing provides an apparatus primarily developed for the purpose of attachment to a user's ear to protect a sensitive newly formed piercing in the ear lobe.

SUMMARY OF THE INVENTION

In view of the foregoing disadvantages inherent in the known types of devices for protecting sensitive ear piercing from contact with other objects now present in the prior art, the present invention provides a new clip on protective earring construction wherein the same can be utilized for attachment to a user's ear to protect a sensitive newly formed piercing in the ear lobe.

The general purpose of the present invention, which will be described subsequently in greater detail, is to provide a new clip on protective earring apparatus and method which has many of the advantages of the devices for protecting sensitive ear piercing from contact with other objects mentioned heretofore and many novel features that result in a new clip on protective earring which is not anticipated, rendered obvious, suggested, or even implied by any of the prior art devices for protecting sensitive ear piercing from contact with other objects, either alone or in any combination thereof.

To attain this, the present invention generally comprises a pair of body members pivotally coupled together so that inner faces of the body members face each other. The inner faces of the body members are biased towards one another. The inner face of each body member has a concave cupped region with an arcuate pad disposed therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new clip on protective earring apparatus and method which has many of the advantages of the devices for protecting sensitive ear piercing from contact with other objects mentioned heretofore and many novel features that result in a new clip on protective earring which is not anticipated, rendered obvious, suggested, or even implied by any of the prior art devices for protecting sensitive ear piercing from contact with other objects, either alone or in any combination thereof.

It is another object of the present invention to provide a new clip on protective earring which may be easily and efficiently manufactured and marketed.

It is a further object of the present invention to provide a new clip on protective earring which is of a durable and reliable construction.

An even further object of the present invention is to provide a new clip on protective earring which is susceptible of a low cost of manufacture with regard to both materials and labor, and which accordingly is then susceptible of low prices of sale to the consuming public, thereby making such clip on protective earring economically available to the buying public.

Still yet another object of the present invention is to provide a new clip on protective earring which provides in the apparatuses and methods of the prior art some of the advantages thereof, while simultaneously overcoming some of the disadvantages normally associated therewith.

Still another object of the present invention is to provide a new clip on protective earring for attachment to a user's ear to protect a sensitive newly formed piercing in the ear lobe.

Yet another object of the present invention is to provide a new clip on protective earring which includes a pair of body members pivotally coupled together so that inner faces of the body members face each other. The inner faces of the body members are biased towards one another. The inner face of each body member has a concave cupped region with an arcuate pad disposed therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
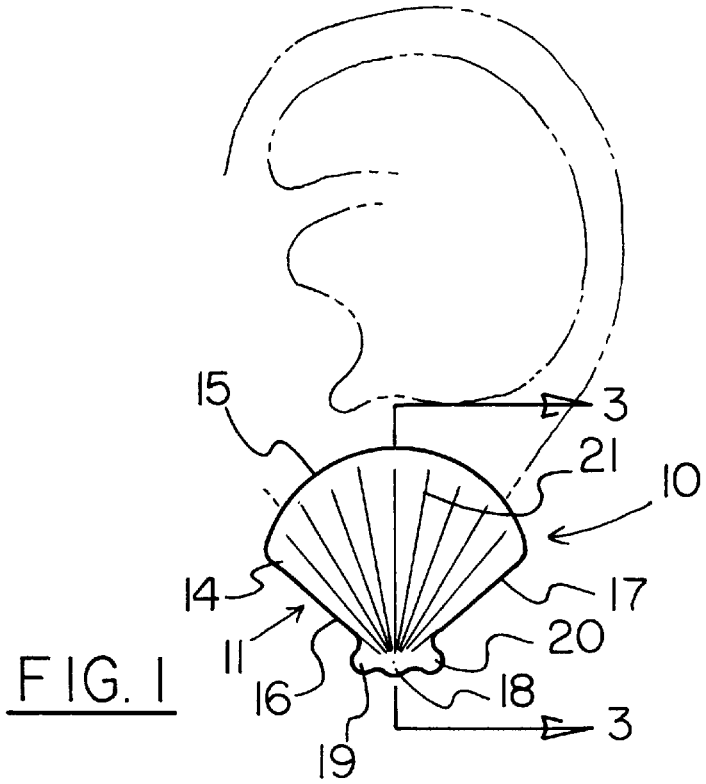
FIG. 1 is a schematic plan view of a clip on protective earring in use on a user's ear according to the present invention.
Figure 2:
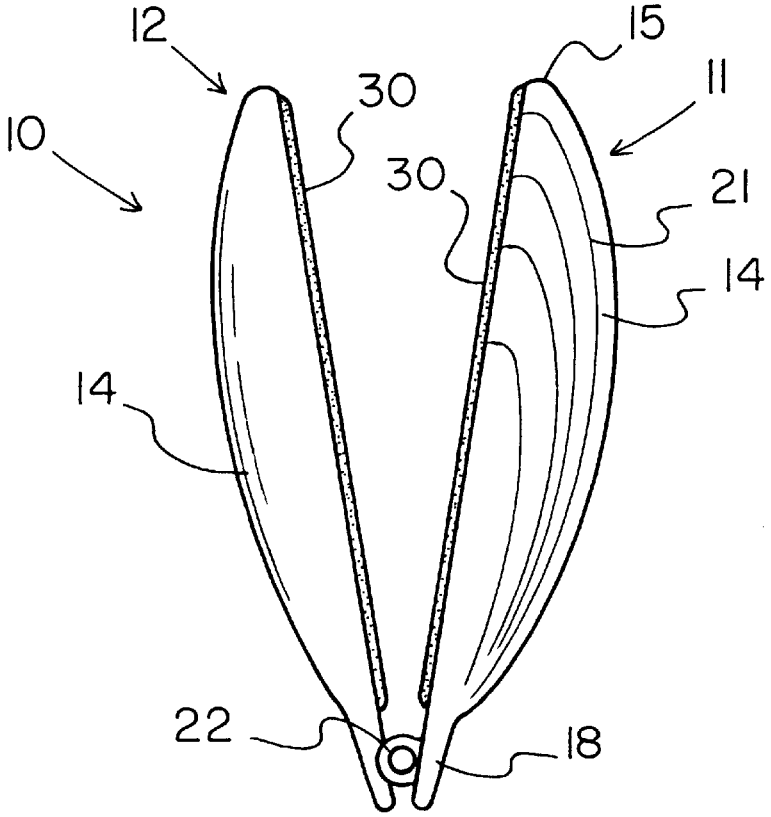
FIG. 2 is a schematic side view of the present invention.

With reference now to the drawings, and in particular to FIGS. 1 through 4 thereof, a new clip on protective earring embodying the principles and concepts of the present invention will be described.

As best illustrated in FIGS. 1 through 4, the clip on protective earring generally comprises a pair of body members pivotally coupled together so that inner faces of the body members face each other. The inner faces of the body members are biased towards one another. The inner face of each body member has a concave cupped region with an arcuate pad disposed therein.

In use, the protective earring is designed for wear on a user's ear. The earring is useful for placing over a preexisting ear stud in the ear so that the clip on earring covers the stud to protect the stud from contact with other objects. This is especially useful to let a user with a newly pierced ear to sleep while protecting the sensitive pierced area of the lobe to be protected from contact from other objects. Is also useful for protecting the stud and ear during exercise or athletics.

In closer detail, the protective earring 10 includes a pair of body members 11,12 each having inner and outer faces 13,14 with the inner faces of the body members facing each other. In one embodiment, the body members each may comprise a plastic material for durability and minimizing allergic reactions to the body members by a user in contact therewith.

The body members each may have a generally seashell-shaped outer perimeter including an arcuate edge 15 and a pair of side edges 16,17 converging together to a hinge end 18. The hinge end of each body member may have an oppositely extending pair of shell wings 19,20. The outer face of each body member is convex in form in this embodiment. Additionally, the outer face of at least one of the body members has a plurality of radial ribs 21 extending radially outwards from the hinge end to the arcuate edge. The ribs help to enhance the structural strength of the body members.

The body members is pivotally coupled together adjacent the hinge ends of the body members. The inner faces of the body members are biased towards each other as well. In one embodiment, a hinge 22 pivotally couples the body members together. In such an embodiment, a spring 23 biases the inner faces of the body members towards each other.

Figure 3:
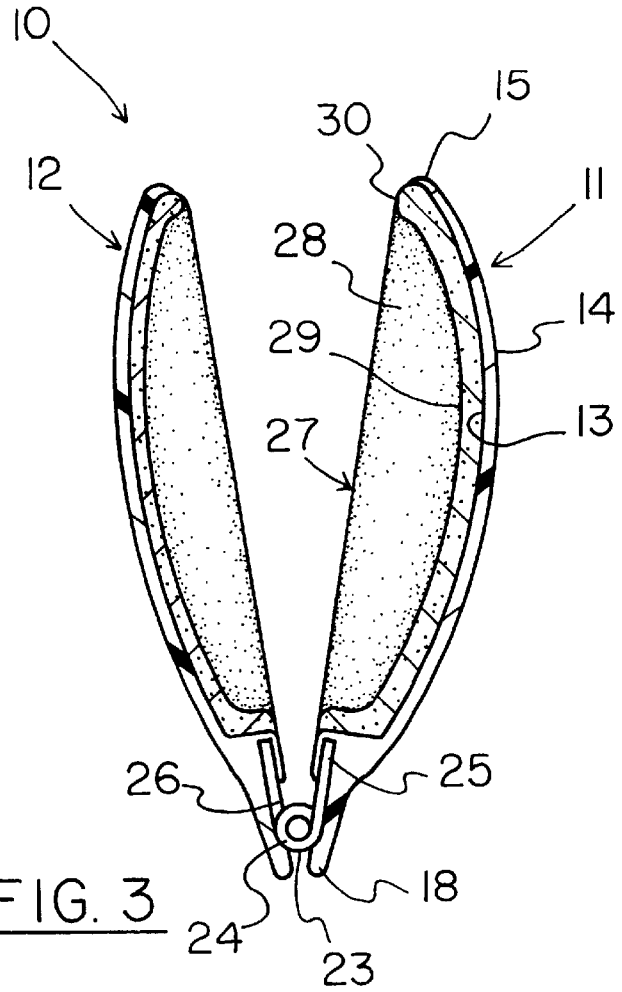
FIG. 3 is a schematic cross sectional view of the present invention taken from line 3—3 of FIG. 1.

One possible embodiment of the spring comprises a spring with a coiled portion 24 and a pair of elongate arm portions 25,26 outwardly extending from the coiled portion of the spring. As illustrated in FIG. 3, the coiled portion of the spring is interposed between the inner faces of the body members adjacent the hinge ends of the body members. The arm portions extend from the coiled portion in directions towards the arcuate edges of the body members. One of the arm portions of the spring is extended into the inner face of one of the body members and the other of the arm portions of the spring is extended into the inner face of the other of the body members so that each arm portion is embedded into the associated body member.

In use, the inner faces of the body members are designed for positioning an ear of a user therebetween such that the inner faces of the body members are biased towards the ear to pinch the ear between the body members and thereby attach the body members to the ear.

The inner face of each body member has a concave cupped region 27. The cupped regions of the body members face each other.

Each of the body members has an arcuate pad 28 disposed in the cupped region of the respective body member. The pads are designed for providing protective cushioning over a new piercing and the piercing stud worn therein so that the new piercing is protected and padded from contact with other objects such as when the user is lie down, exercising or even talking on a phone. The pads also are designed for providing cushioning between the body members and the ear pinched therebetween so that the ear is not pinched to hard by the body members.

The pads each comprises a resiliently deformable material and may comprise a foamed material or even a soft cotton padding material for example. The pads each has a concave exterior face 29 and a convex interior face facing the inner face of the associated body member. The concave exterior faces of the pads face each other. The interior faces of the pads each are coupled to the inner face of the associated body member. In one embodiment, an adhesive interposed between each pad and the associated body member may adhesively couple the respective pad to the associated body member. The cupped nature of the outer faces helps prevent contact with the stud and piercing region of the lobe by has contact with the regions of the lobe around the stud and piercing region so that there is little or no pressure put on the stud and piercing region and thereby prevent pain to the user from pressure on the stud and piercing region.

The cupped region of each body member has an outer periphery therearound. In one embodiment, each pad may have an outer perimeter outwardly extending past a plane in which the outer periphery of the cupped region of the associated body member so that each pad has a perimeter lip 30 formed between the plane of the outer periphery of the associated cupped region and the outer perimeter of the respective pad member.

Figure 4:
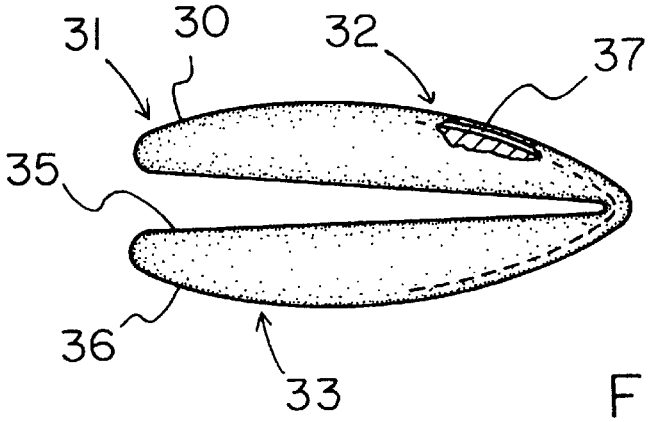
FIG. 4 is a schematic side view of an optional additional embodiment present invention.

FIG. 4 illustrates another optionally embodiment 31 of the protective earring. In this embodiment, a pair of resiliently deformable body members 32,33 are pivotally and integrally coupled together by a flexible connective portion 34 therebetween. The body members each have a planar inner face 35 and convex arcuate outer face 36. The body members each may even have a seashell shaped outer perimeter. In such an embodiment, the body members may each comprise a resiliently deformable foamed material.

An elongate pliable element 37 is disposed in the body members and extended therebetween through the connective portion. In use, the pliable element is bendable to a position where the inner faces of the body members face each other and such that an ear of a user may be positioned therebetween such that the ear is pinched between the body members to attach the body members to the ear of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An earring, comprise:

a pair of body members each having inner and outer faces, said inner faces of said body members facing each other;

said body members each having an outer perimeter including an arcuate edge and a pair of side edges converging together to a hinge end, said hinge end of each body member having an oppositely extending pair of wings;

said outer face of each body member being convex in form;

said outer face of at least one of said body members having a plurality of radial ribs extending radially outwards from said hinge end to said arcuate edge;

said body members being pivotally coupled together adjacent said hinge ends of said body members, said inner faces of said body members being biased towards each other;

wherein a hinge pivotally couples said body members together;

wherein a spring biases said inner faces of said body members towards each other;

said spring having a coiled portion and a pair of elongate arm portions outwardly extending from said coiled portion of said spring;

said coiled portions of said spring being interposed between said inner faces of said body members adjacent said hinge ends of said body members;

said arm portions extending from said coiled portion in directions towards said arcuate edges of said body members;

one of said arm portions of said spring being extended into said inner face of one of said body members and the other of said arm portions of said spring being extended into said inner face of the other of said body members;

said inner faces of said body members being adapted for positioning an ear of a user therebetween such that said inner faces of said body members are biased towards the ear to pinch the ear between said body members and thereby attach said body members to the ear;

said inner face of each body member having a concave cupped region, said cupped regions of said body members facing each other, said concave region of the faces being adapted for minimizing contact between the inner faces and with a stud and piercing region of a lobe and thereby preventing pain to a user from pressure on the stud and piercing region;

each of said body members having an arcuate pad disposed in said cupped region of the respective body member for minimizing pressure points between said body members and an ear;

said pads each comprising a resiliently deformable material;

said pads each having a concave exterior face and a convex interior face facing the inner face of the associated body member, said concave exterior faces of said pads facing each other;

said interior faces of said pads each being coupled to the inner face of the associated body member; and said cupped regions of each body member having an outer periphery therearound, each pad having an outer perimeter outwardly extending past a plane in which said outer periphery of the cupped region of the associated body member such that each pad has a perimeter lip formed between said plane of the outer periphery of the associated cupped region and the outer perimeter of the respective pad member, an entirety of said perimeter lips of said pads being positionable in an abutted condition to form a closed interior therebetween when said body members are pivoted toward each other.

* * * * *